United States Patent [19]

Jaconette

[11] 4,229,065

[45] Oct. 21, 1980

[54] ELECTRICAL CONTACT WITH TORSION BARS

[75] Inventor: Frank C. Jaconette, Trumbull, Conn.

[73] Assignee: Harvey Hubbell, Incorporated, Orange, Conn.

[21] Appl. No.: 17,130

[22] Filed: Mar. 5, 1979

[51] Int. Cl.[3] ..... H01R 13/11

[52] U.S. Cl. ..... 339/258 T; 339/258 R

[58] Field of Search ..... 339/258 R, 258 F, 258 P, 339/258 S, 258 T, 256 SP, 259

[56] References Cited

U.S. PATENT DOCUMENTS

| | | | |
|---|---|---|---|
| 3,142,891 | 8/1964 | Travis | 29/155.55 |
| 3,192,498 | 6/1965 | Ruehlemann | 339/33 |
| 3,299,396 | 1/1967 | Kinkaid | 339/258 |
| 3,713,079 | 1/1973 | Dechelette | 339/258 R |
| 3,732,529 | 5/1973 | Weisenburger | 339/258 P |
| 4,035,049 | 7/1977 | McKee | 339/258 R |
| 4,068,917 | 1/1978 | Seidler | 339/258 R |

FOREIGN PATENT DOCUMENTS

| | | | |
|---|---|---|---|
| 1294485 | 10/1972 | United Kingdom | 339/258 R |

*Primary Examiner*—John McQuade

*Attorney, Agent, or Firm*—Jerry M. Presson

[57] ABSTRACT

Disclosed is a female contact of unitary construction employing a torsion bar joined at one end to one of two opposing, spaced apart, elongated contact blades. The two blades have a relatively high spring rate and are forced apart when a male contact is inserted between the blades to provide the desired contact retention forces. One of the two contact blades is oriented edgewise with respect to the plane of a rigid opposing blade to provide a high spring rate in the direction of outward displacement. The outward displacement of the edgewise-oriented blade and hence the contact pressures applied thereby to the male contact are primarily a function of the torsional characteristics of the torsion bar to which it is joined. If desired, this contact pressure may be essentially doubled by providing two juxtaposed edgewise-oriented contact blades, each joined to a respective torsion bar.

16 Claims, 4 Drawing Figures

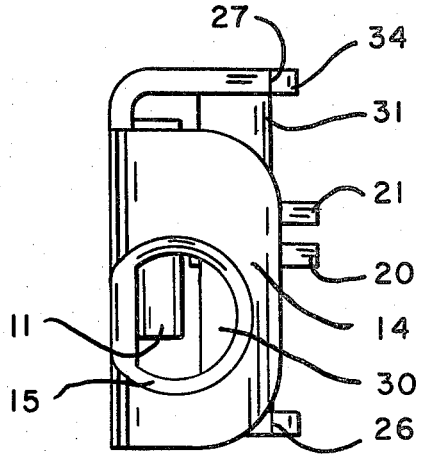
FIG. 4
FIG. 1
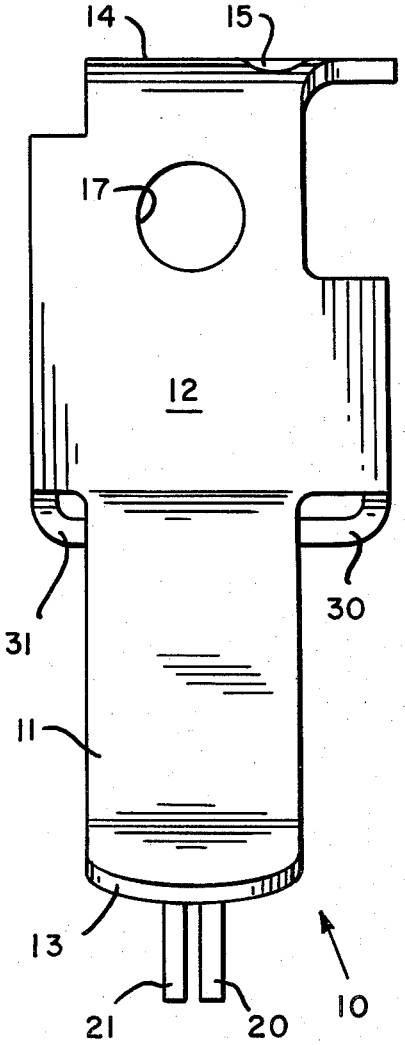
FIG. 2
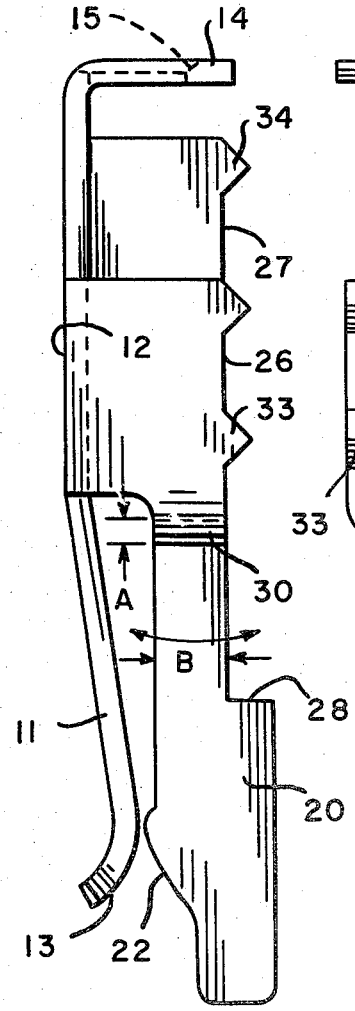
FIG. 3
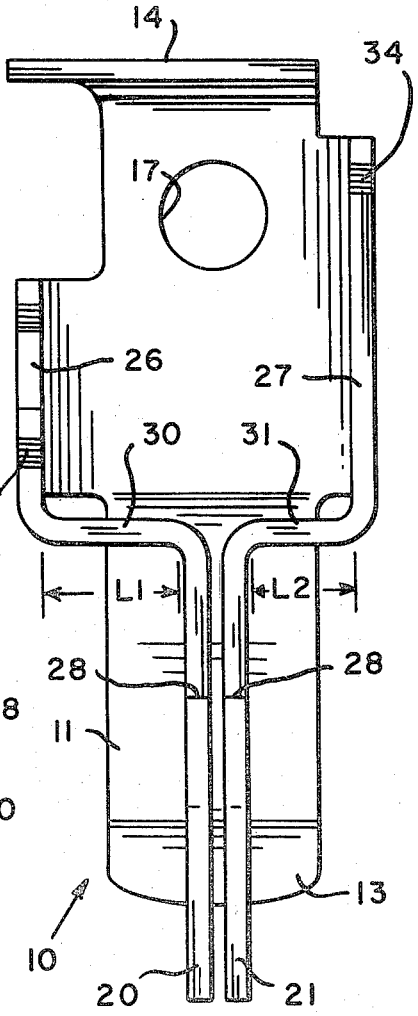

ELECTRICAL CONTACT WITH TORSION BARS

This invention relates to electrical contacts and more particularly to female electrical contacts of one-piece construction for use in conventional electrical wiring devices, such as electrical plugs and receptacles.

BACKGROUND OF THE INVENTION

Electrical wiring contacts which are used to effect electrical terminations in electrical wiring devices such as electrical plugs, receptacles and connectors, are conventionally fabricated from a single blank of metal having good electrical conductivity. Metals used for this purpose are typically composed of various alloys of brass and copper because they provide the requisite conductivity and the spring rate needed to apply the necessary spring pressure against the mating male contact blade. Contacts formed by bending or otherwise forming a single blank of metal into appropriate contact shapes are often preferred because they require a minimum inventory of piece parts and usually provide excellent reliability in usage.

An important consideration in the design of unitary female contacts is to ensure that the optimum contact pressures established in manufacture is also maintained during usage. It is especially important that the yield point of the metal composition forming the contact not be exceeded. If the yield point of the metal is exceeded, the contact blade will take a permanent set and subsequently may not provide the desired contact pressures.

Prior art female contacts of unitary construction often utilize an elongated, cantilevered contact blade composed of a suitable spring material mounted opposite and parallel to another elongated contact blade. A gap formed between the opposing free ends of the two blades receiving the male contact. The cantilevered blade may be analogized, from a structural standpoint, to a beam which is fixed at one end but free at the other end. Deflection of the beam about its fixed end results from engagement with the male contact blade and produces shear and tensile stresses in the beam. If these stresses exceed the yield point of the material forming the beam, the beam will take a permanent set and lose its effectiveness as a resilient contact. Therefore, unless supplementary reinforcement means of some type is employed to prevent overstressing of contact blades, or very specially alloyed metal compositions are used, the female contacts function reliably for only one range of male contact thickness. When resorting to the use of specially alloyed contact compositions, the contact manufacturers are confronted with substantial quality control problems in assuring that the correct relative amounts of the various compositions are present in the contacts for optimum characteristics.

In the case of electrical wiring devices, various constraints are imposed upon the maximum length permitted of the female contacts and therefore, it is usually not possible to decrease the bending stresses in the contact blades by merely increasing their blade lengths. Additionally, to prevent overheating of the contacts, the male blade thickness typically increases with increases in their nominal current-carrying rating. For example, a 20 ampere locking-type plug has a nominal blade thickness of 0.060 inch (1.5 mm.), whereas a 30 ampere plug of the same type has a nominal blade thickness of 0.070 inch (1.8 mm.). Usually, if the female contact is designed to provide the requisite restraining forces for the 20 ampere blade, it will not provide the requisite restraining forces for a 30 ampere rated plug without running the risk of exceeding the yield point of the female contact. For this reason, different inventories of female contact sizes are usually required to accommodate plug blades of different current ratings and thicknesses. The aforementioned problems are overcome in large measure by the female contact of the instant invention.

SUMMARY OF THE INVENTION

The female contact of the instant invention is formed of a single piece of metal with good electrical conductivity and is designed to be mounted in a cavity formed in an insulated base or holder of an electrical wiring device, such as a plug or receptacle. The contact has two opposing, spaced apart contact members. Both members are elongated, but have relatively high spring rates and, therefore, do not bend appreciably about their longitudinal axes to apply restraining forces against a male blade inserted into the gap formed by the outward ends of the members. In the case of the first member, a high spring rate results from forming this member as a single blade with a relatively large contact surface for heat dissipation and a thickness dimension which is the same as that of the blank from which this blade is formed. In the case of the second member, a high spring rate is provided by orienting one blade, and more typically two juxtaposed blades, edgewise with respect to the contact surface of the first blade and hence, the major plane of blade displacement. A torsion bar joins the inner end of the second member to the stationary part of the contact and acts as a torsional spring with a relatively low spring rate thereby permitting the second member to undergo the major amount of outward deflection without exceeding its yield point or the yield point of the torsion bar.

Contacts of the type presently under consideration typically are constrained to certain maximum length dimensions by the length of the wiring device pockets in which they are mounted or by various regulations relating to the standardization of wiring device contact dimensions. The female contact of this invention can provide the desired male blade restraining forces to more than one range of male blade contact thickness and desirably, permits the same contact to be used with male contacts having different nominal blade thicknesses and current ratings, for example, male contacts having both 20 and 30 ampere ratings. Moreover, the female contact accommodates male blades which can have both straight blade and locking blade configurations, thereby reducing the parts inventory of the device manufacturer.

OBJECTS OF THE INVENTION

It is an object of this invention to provide a new and improved female contact.

Another object of this invention is to provide a female electrical contact of unitary construction which provides adequate contact pressure against male contact blades of different nominal thickness ranges.

Another object of this invention is to provide a female contact assembly of unitary construction which applies the desired contact pressure against a male contact blade principally from a source of torsional restoring forces.

Yet another object of this invention is to provide a unitary female contact which may be readily manufactured from material composed of conventional spring compositions and yet provides adequate contact pressures against male blades of more than one range of standard thickness.

Still another object of this invention is to provide a female electrical contact structure of unitary, spring construction for use in female electrical wiring devices which provides adequate contact pressure against male contact blades having both straight blade and locking blade types of configurations.

BRIEF DESCRIPTION OF THE DRAWINGS

In order that the manner in which the foregoing and other objects are attained in accordance with the invention can be understood in detail, a particularly advantageous embodiment thereof will be described with reference to the accompanying drawings, which form a part of this specification, and wherein:

FIG. 1 is a top plan view of a female contact constructed in accordance with this invention;

FIG. 2 is a right side elevation of the contact structure illustrated in FIG. 1;

FIG. 3 is a bottom plan view of the contact illustrated in FIG. 1; and

FIG. 4 is an end elevation of the instant contact as viewed from the rearward end thereof.

DETAILED DESCRIPTION OF THE INVENTION

As illustrated in FIG. 1, the female contact 10 is designed to be inserted into a suitable cavity or pod of an electrical wiring device, not shown, the contact being formed from a plate of a metal having good electrical conductivity characteristics such as brass or a suitable brass alloy. It will be understood that conventional wiring devices commonly have a plurality of contact pods or pockets arranged circumferentially around the longitudinal axis of the device to receive the similarly disposed multibladed male contacts extending from one end of a mating plug. The contact may be formed from a single plate of metal by conventional metal shearing and bending operations. The contact includes a contact blade 11 of rectangular cross section and opposing contact blades 20, 21. The male contact blade which is to be inserted between blade 11 and blades 20, 21 may be of a straight blade or of a locking type having locking tabs on either its leading or its trailing edges and a generally arcuate cross-sectional shape.

Blade 11 has the same thickness dimension as that of the the blank from which contact 10 is formed in manufacture. Blade 11 has a width dimension which may be substantially equal to the maximum width of the male contact it receives, particularly if the male contact has a locking configuration with a laterally projecting trailing or leading locking tab. Blade 11 will deflect when driven outwardly by engagement with the male contact blade, but its deflection is substantially less than that of opposing contact blades 20 and 21, and typically constitutes only a minor amount of the total outward displacement between the contact blades, the majority of outward displacement being due to blades 20 and 21.

The rearward end of blade 11 is an integral extension of a relatively flat terminal plate or base 12 and its forward end is free and bent outwardly to provide a diverging lip portion 13 for guiding the male blade into the gap between the opposing blades of contact 10. The rearwardmost end of plate 12 is bent downwardly to provide a flat end plate 14 extending at right angles to plate 12. Plate 14 has an opening 15 extending perpendicularly therethrough (FIGS. 1, 2 and 4) of sufficient diameter to accommodate an electrical cord comprised of a plurality of substantially parallel or twisted electrical conductors sheathed together in a jacket of electrical insulating composition.

Extending perpendicularly through plate 12 is a smooth cylindrical opening 17 of sufficient diameter to freely accommodate a clamping screw which is threaded axially into a conductor clamping nut, not shown, the nut being located in use between the two upstanding terminal plates 26 and 27, respectively, to receive the clamping screw which is inserted through opening 17 from the opposite side. Plates 26 and 27 constrain the clamping nut against rotation so that the nut can be drawn down by turning the clamping screw to clamp the bare ends of the conductors firmly against plate 12.

Extending parallel to the longitudinal axis of blade 11 is a pair of parallel, juxtaposed contact blades 20 and 21, respectively. The blades are cut from the single metal plate and are of identical size and shape. An inwardly projecting protuberance 22 is provided at the free end of each blade (FIG. 2) to ensure that a good point contact is developed between the male blade and the contact blades 20 and 21. As mentioned, the male blade may have a straight blade or a locking blade configuration. With the latter configuration, the blade has a leading or a trailing laterally projecting tab and after the male blades are inserted into their axially respective female contacts, the male plug is rotated through a small arc of prescribed angle causing its locking tab to slide edgewise between blade 11 and blades 20 and 21. The female contact of this invention will accept conventional locking-type blades with leading or trailing tabs. Protuberances 22 are positioned opposite the diverging surface of contact blade 11 and at their inwardmost points define the minimum gap spacing between blades 20 and 21 and blade 11, respectively. This minimum spacing is normally slightly less than the nominal thickness of the range of sizes of male blades to be received.

Blades 20 and 21 are mounted in an edgewise orientation, that is, an orientation such that their major faces lie in planes perpendicular to planes containing blade 11 and such that their inner and outer edges are perpendicular to the plane of blade deflection which is essentially perpendicular to the major plane of blade 11. The rearward ends of the blades 20 and 21 are joined to side walls 26 and 27, respectively, by torsion members 30 and 31, respectively, which will be described in greater detail. The planar surfaces of side walls 26 and 27 are aligned substantially parallel to one another and to planar major surfaces of blades 20 and 21 (FIGS. 1 and 3). Blade 11 is inclined inwardly as best shown in FIG. 2 and the edges of both of blades 20 and 21 facing away from blade 11 are stepped outwardly substantially midway along their lengths, forming a shoulder indicated at 28, to ensure that they have sufficient width to provide maximum resistance to bending about their longitudinal axes when subjected to outwardly directed stresses caused by the engagement of blades 20 and 21 with the male blade.

As will be evident, with an edgewise orientation, blades 20 and 21 present a maximum resistance to bending about their longitudinal axes in the plane of bending under normal usage situations because their moments of area are greater in this plane. Hence, blades 20 and 21 themselves effectively resist any significant bending or outward displacement of their free ends caused by the insertion of a male blade into the gap between blades 20 and 21 and blade 11. However, it is desirable to provide a mounting for blades 20 and 21 which permits blades 20 and 21 to be driven practically simultaneously outwardly in a counterclockwise direction, as viewed in FIG. 2, without causing any bending of a type or extent which might tend to exceed the yield point of the material used, and which provides forces to counteract the outward displacement of blades 20 and 21 and to apply the desired frictional engagement and restraining forces against the male contact.

This is accomplished by the mounting structure in which blades 20 and 21 are joined to the outer ends of side walls 26 and 27, respectively, by means of torsion bars 30 and 31, respectively. Torsion bars 30 and 31 are joined at one end to the outer, forward edges of side walls 26 and 27, respectively, and at their opposite ends to the rearward ends of blades 20 and 21, respectively. The longitudinal axes of the bars are substantially perpendicular to the planes of sidewalls 26 and 27 and to the longitudinal axes of contact blades 20 and 21. Because they are formed from a blank of rectangular cross section, torsion bars 30 and 31 are similarly rectangular in cross section. Their narrower edges designated by the letter A are equal to the thickness or depth of the blank and are turned to face the opposite contact surfaces of contact 11. The widths of the torsion bars, designated by the letter B, are equal to the widths of contacts 20 and 21 at the region where they join bars 30 and 31, respectively, and this dimension may be varied, by changing the position of the blanking die with respect to the edges of the blank, to change the spring rate (or spring constant) of the bars. By increasing this dimension, the spring rate is increased and conversely, by decreasing this dimension, the spring constant is decreased thereby providing the bars with less resistance to torsional displacement and hence, greater permissible deflection to blades 20 and 21 relative to contact blade 11.

It will be understood that, as used herein, the term "torsion spring" refers to a type of spring, also known as a "torsion bar", in which a bar or shaft or circular or other cross section is supported at one end and subjected to a torque at the other end so that the bar twists through an angle, the magnitude of which is directly proportional to the product of the torsional modulus of the bar and the polar moment of inertia. This form of spring thus stores energy in a twisting movement resulting from the torque. Bending effects are normally negligible. The spring rate (or spring constant) is the ratio of the force applied (torque divided by torque arm) to the deflection at the point of application of the force which, in the embodiment described, would be primarily at the protuberance 22. For a further discussion of this topic, reference is made to the *Handbook of the Engineering Sciences*, James H. Potter, Vol. II (D. Van Nostrand Company, Inc., Princeton, N.J., 1967), pages 1005–7; and to *Mechanics of Materials*, Higdon et al (John Wiley and Sons, Inc., New York, 1976), particularly chapter 4 beginning at page 169 and entitled, "Torsional Loading".

Depending upon the desired relative position of blades 20 and 21 with respect to the longitudinal axis of blade 11, and the relative positions of side walls 26 and 27, effective lengths L1 and L2 of respective torsion bars 30 and 31 may be made equal or unequal as illustrated. Blades 20 and 21 may be spaced laterally from one another or lie in abutting relationship to suit the particular application.

The two contact elements which are formed by parallel contact blades 20 and 21 and their respective torsion bars 30 and 31 combine to present a generally T-shaped configuration, viewed in plan, because the intersections or junctions of the longitudinal axes of the blades and their respective torsion bars are in planes at right angles to one another.

To facilitate the attachment of the contact to the side walls of a cavity in which the contact is mounted, each side wall 26 and 27 is cut in such a way as to leave one or more outwardly projecting ridges 33 and 34, respectively. These ridges converge to sharp points which can dig into the relatively softer insulation composing the contact pocket side walls to firmly secure the contact in a female wiring device.

The torsion bars with blades 20 and 21 extending therefrom are initially cut from a single flat blank of, for example, a conventional brass alloy by punching out the blank to leave two strips on opposite edges of the blank with the desired bar and blade configuration. By suitable bending operations, the desired right angle bends can be provided between side walls 26 and 27 and outer ends of torsion bars 30 and 31, respectively, and between the inner ends of bars 30 and 31 and the inner ends of blades 20 and 21, respectively. The torsion bars are also edgewise-oriented with respect to blade 11 so that, like blades 20 and 21, their greater moments of area are parallel the the plane of maximum bending stresses produced by outward displacement of blades 20 and 21. The cross-sectional area of each bar is essentially equal to that of its associated blade to ensure that each bar will not bend about its longitudinal axis to any greater extent than blade 20 or 21 to which it is joined.

Inasmuch as torsion bars 30 and 31 and their respective contact blades 20 and 21 are substantially rigid throughout their lengths in their plane of displacement, and because contact 11 has a high spring rate and therefore undergoes only minimal deflection in normal usage, the counterforces developed by the twisting and untwisting of the torsion bars throughout their respective straight sections primarily determines the frictional forces whch are exerted against the male blade by blades 20 and 21.

These counterforces constitute the major forces counteracting the angular displacements of the rearward ends of blades 20 and 21. Typically, at least 75 percent of the total deflection between blade 11 and blades 20 and 21 at their male-contact engaging surfaces is attributable to blades 20 and 21, turning on their respective torsion bars with the major part of the remainder of the total deflection being attributable to blade 11 bending in a plane perpendicular to its major surfaces and containing its longitudinal axis.

As will be apparent, the contact may be formed from a single blank of appropriate composition by single blanking and bending operations and therefore, it is relatively easy and inexpensive to manufacture. Because of its one-piece construction, the electrical continuity between the various parts of the contact is assured.

While one advantageous embodiment has been chosen to illustrate the invention it will be understood by those skilled in the art that various changes and modifications can be made therein without departing from the scope of the invention as defined in the appended claims.

What is claimed is:

1. An improved female electrical contact composed of an electrically conductive material including, a base portion and at least one upstanding side wall portion extending perpendicularly from an edge of said base portion, a first elongated contact element joined at one end to said base portion and extending from said base portion to terminate in a free end, said first contact element having a longitudinal axis and a contact surface, a second elongated contact element having a longitudinal axis substantially parallel to the longitudinal axis of said first contact element, having an inner surface facing and spaced from said contact surface of said first contact element and forming a gap therewith into which a male contact blade can be inserted to make an electrical contact with the female contact, having a significantly greater rigidity in a plane perpendicular to the plane containing said gap than in planes parallel thereto, and having a free end, a torsion bar spaced from said base portion and having a longitudinal axis, said bar extending laterally from said one side wall portion at substantially a right angle thereto toward the longitudinal axis of said second contact element, and being joined to the end of said second contact element opposite said free end with the longitudinal axes of said bar and said second element at substantially right angles, said bar, said base, said side wall portion and said first and second elements being of unitary construction whereby the insertion of the male contact blade into the gap tends to twist said bar and produces torsional forces therein which resist the outward displacement of the free end of said second contact element.

2. The contact according to claim 1 and including two upstanding side wall portions extending perpendicularly from opposite edges of said base portion to form a channel-shaped section, said side wall portions being substantially rectangular in cross section and wherein the planes of said side wall portions are substantially parallel to the longitudinal axis of said first contact element.

3. The contact according to claim 1 wherein said torsion bar extends from an edge of said side wall portion adjacent said one end of said first contact element and has a substantially rectangular cross section.

4. The contact according to claim 2 and including a plurality of torsion bars of rectangular cross section extending laterally from different edges of said side wall portions adjacent said one end of said first element, said bars being in substantially coaxial alignment and further, wherein there are a pair of second contact elements in substantial longitudinal and transverse alignment, each of said second elements depending from an end of a respective one of said bars adjacent the longitudinal axis of said first contact element.

5. The contact according to claim 4 wherein said bars have a pair of opposite edge surfaces, one edge surface of each pair facing said inner surface of said first contact element.

6. The contact according to claim 5 wherein said pair of opposite edge surfaces have smaller respective dimensions than the respective dimensions of their two adjoining surfaces.

7. The contact according to claim 3 wherein said second contact element has a substantially rectangular cross section with one pair of opposite edge surfaces of smaller dimension than their adjoining surfaces, said second contact element oriented with one edge surface of smaller dimension facing said first contact element, whereby said second contact element provides a substantial resistance to bending in directions toward and away from the first contact element and outward displacement of said second contact element is primarily counteracted by said torsion bar.

8. The contact according to claim 7 which includes first and second upstanding side wall portions extending perpendicularly from opposite, parallel edges of said base portion, first and second torsion bars extending toward each other from said first and second wall portions, respectively, and wherein the second contact element comprises a pair of contact blades disposed in juxtaposed relationship, each of said blades being joined to one of said torsion bars.

9. The contact according to claim 5 and further comprising a protuberance mounted on the surface of each of the second contact elements adjacent the free end thereof, the protuberances being in lateral alignment for making good electrical contact with a male blade.

10. The contact according to claim 1 and further comprising at least one tooth projecting from the edge of a side wall portion for securing the mounting of the contact to a housing of an electrical wiring device.

11. The contact according to claim 3 wherein said bar extends substantially parallel to opposite surfaces of said first contact element.

12. The contact according to claim 7 wherein the portion of said torsion bar joined to said second contact element has a rectangular cross section defined by opposite edge surfaces of smaller respective dimensions than the respective dimensions of their two adjoining surfaces, and wherein one edge surface of the pair faces the surface of said first contact element whereby said second contact element and said torsion bar are substantially rigid in the direction of outward displacement of said second contact element.

13. In a female contact assembly, at least one first elongated contact blade having a free end which makes electrical contact with a male contact member, said first contact blade having a greater rigidity throughout its length to bending in one plane than in a second, orthogonal, plane, a second contact blade having means defining a surface forming, with said first elongated contact member blade, a gap for receiving the male contact, a support, and an elongated, substantially linear, torsion bar fixedly mounted at one end to the support and joined at the opposite end thereof to an end of said first contact blade opposite its free end, said torsion bar applying torque to oppose the outward displacement of the free end of said first contact blade without bending of said first contact blade caused by the male contact member, said first contact blade being oriented so that displacement thereof occurs in substantially said one plane, and whereby the pressure provided against the male contact member by the free end of said first contact blade is established primarily by said torsion bar.

14. The female contact according to claim 13 and wherein said second elongated contact blade has one end mounted on said support and an opposite end free, said surface of said second contact blade being inclined toward said one contact blade so that the free end thereof is spaced a predetermined distance from the free end of said one contact blade for receiving the male contact therebetween.

15. A female contact structure of unitary construction composed of a material of good electrical conductivity and comprising:

a channel-shaped contact member having a planar base portion to which an electrical conductor may be connected, said member being formed with opposite end portions and with two side portions extending upwardly from the plane of said base portion, an elongated contact blade extending from one of said end portions, and a contact element having a portion of generally T-shaped configuration in plan, the vertical leg of the configuration positioned opposite said contact blade and defining a gap therebetween into which a male contact may be inserted, said vertical leg being substantially parallel to the longitudinal axis of said contact blade and being substantially rigid against bending, the horizontal leg of said contact element being spaced outwardly from said base portion and having its opposite ends joined to a different one of the upwardly extending side portions, whereby the horizontal leg twists about its horizontal axis to resist angular displacement of the vertical leg caused by the insertion of the male contact into the gap.

16. The female contact structure according to claim 15 wherein the vertical and horizontal legs are of substantially rectangular cross-sectional shape defined by mutually opposing surfaces of different respective dimensions, said vertical and horizontal legs having surfaces of greater dimension oriented to provide a substantially maximum resistance to bending of said contact element.

* * * * *